US012408770B2

(12) United States Patent
Maccarone

(10) Patent No.: US 12,408,770 B2
(45) **Date of Patent: *Sep. 9, 2025**

(54) GARMENT DISPLAY DEVICE

(71) Applicant: Jersey Racks LLC, Gibbstown, NJ (US)

(72) Inventor: Samuel Maccarone, Gibbstown, NJ (US)

(73) Assignee: Jersey Racks LLC, Gibbstown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/488,580

(22) Filed: Oct. 17, 2023

(65) Prior Publication Data

US 2024/0057793 A1 Feb. 22, 2024

Related U.S. Application Data

(63) Continuation-in-part of application No. 17/369,071, filed on Jul. 7, 2021, now Pat. No. 12,004,668.

(60) Provisional application No. 63/050,219, filed on Jul. 10, 2020.

(51) Int. Cl.

| | |
|---|---|
| ***A47F 7/19*** | (2006.01) |
| ***A47G 25/40*** | (2006.01) |
| ***A47G 25/44*** | (2006.01) |

(52) U.S. Cl.

CPC ..... *A47F 7/19* (2013.01); *A47G 25/4061* (2013.01); *A47G 25/447* (2013.01)

(58) Field of Classification Search

CPC ..... A41H 5/00; A41H 5/01; A47B 61/003; A47F 7/22; A47F 7/26; A47F 8/00; A47F 8/02; A47G 25/0607; A47G 25/0685; A47G 25/441; A47G 25/442; A47G 25/443; F16M 13/022; F16M 13/027

See application file for complete search history.

(56) References Cited

U.S. PATENT DOCUMENTS

| | | | | |
|---|---|---|---|---|
| 38,631 A * | 5/1863 | Patton | A47G 25/0685 211/96 |
| 429,022 A * | 5/1890 | Etzel | A47G 25/0685 211/96 |
| 1,188,921 A | 6/1916 | Finkelstein | |
| 1,833,503 A | 11/1931 | Sumner | |
| 2,157,822 A | 5/1939 | French | |
| 2,188,986 A | 2/1940 | Schwartz | |
| 2,233,492 A | 3/1941 | Sperry | |

(Continued)

*Primary Examiner* — F Griffin Hall

(74) *Attorney, Agent, or Firm* — Fox Rothschild LLP

(57) ABSTRACT

Garment display devices and methods of use are provided. The garment display device may comprise an attachment base comprising a left support arm and a right support arm and an anchor panel positioned between the left support arm and the right support arm. The anchor panel may be configured to be secured to a surface. The garment device may comprise a right primary arm plate rotatably attached to the right support arm and a left primary arm plate rotatably attached to the left support arm. The right and left primary arm plates may each comprise a plate support member comprising an upper surface, a lower surface, one or more side surfaces, and a recess within one of the lower or upper surfaces. The right and left primary arm plates may comprise an extender member. The extender member may be configured to be slidable within the recess.

15 Claims, 5 Drawing Sheets

(56) References Cited

U.S. PATENT DOCUMENTS

| | | | |
|---|---|---|---|
| 2,410,230 | A | 10/1946 | Parker, Jr. |
| 2,657,842 | A | 11/1953 | Smith |
| 2,707,070 | A | 4/1955 | Tanzer |
| 2,803,386 | A | 8/1957 | Brown |
| 3,008,613 | A | 11/1961 | Paris |
| 3,294,295 | A | 12/1966 | Wolf |
| 3,480,187 | A | 11/1969 | Bonn |
| 3,645,425 | A | 2/1972 | Witzke |
| 4,311,260 | A | 1/1982 | Toy |
| 4,333,575 | A | 6/1982 | Wong |
| 4,545,514 | A | 10/1985 | Toy |
| 4,739,911 | A | 4/1988 | Quinn |
| D309,834 | S | 8/1990 | Passini |
| 6,601,326 | B1 | 8/2003 | Bublitz et al. |
| 8,146,784 | B1 | 4/2012 | Calanca et al. |

* cited by examiner

GARMENT DISPLAY DEVICE

CROSS-REFERENCE TO RELATED APPLICATION

The present application is a continuation-in-part of, and claims priority to, U.S. patent application Ser. No. 17/369,071, entitled "GARMENT DISPLAY DEVICE," which claims priority to U.S. Provisional Patent Application No. 63/050,219, filed Jul. 10, 2020, entitled "GARMENT DISPLAY DEVICE," all of which are incorporated herein by reference in their entirety.

TECHNICAL FIELD

Embodiments of the present disclosure relate to a device for displaying garments, and methods of using the same.

BACKGROUND

Sports fans enjoy wearing and displaying clothing bearing the names and/or logos of their favorite sports teams. However, oftentimes, fans have to make a choice between displaying or wearing their sports garments. A common way to display sports garments, including, but not limited to, collectible garments, is to seal the sports garment within a display case, commonly known as a shadow box, jersey case, jersey display, or shirt case, which can be hung on a wall or otherwise displayed for viewing. The sports garment is secured within the display case, under a panel of glass, through which the sports garment can be observed. However, this is often not desirable because, once the sports garment is encased behind the glass of the display case, the sports garment can no longer be worn. Further, this type of display does not present the sports garment in an authentic or life-like manner. While a life-like display could be achievable by placing the garment on a mannequin instead of in a display case, this, undesirably, would take up floor space. Also, conventional display cases only convey limited information, namely either the front or the back of the sports garment that is viewable to an observer.

Those choosing not to frame their sports garments tend to leave them hanging in their closets, which does not afford the opportunity for the garment owner, and others, to openly admire the sports garment. Even if one were to use a conventional hanger to hang the sports garment outside of the closet, the hanger would not be able to display a variety of garments, having different sleeve lengths, in a visually pleasing way.

Additionally, sports fans enjoy collecting a variety of sports paraphernalia, such as, e.g., trophies, books, figurines, hats, tools, and the like. Oftentimes, one will find such sports paraphernalia located at various locations separate from sports garments. It would be desirable for these fans to be able to assemble and display their sports paraphernalia in one location. It would be even more desirable if they could neatly display their collectible objects alongside a display of their favorite sports garment or garments.

For at least these reasons, there is a need for an apparatus that addresses at least one of the above disadvantages. More particularly, there is a need for an apparatus that enables a user to neatly hang their sports garment, while having the ability to easily remove and wear the sports garment when desired, and to easily rehang it for display after wearing it. Additionally, there is a need for such an apparatus that can be adjusted to provide an aesthetically pleasing display of sports garments having different sleeve lengths. Further, there is a need for such a device that also provides the ability to display other types of sports memorabilia.

SUMMARY

According to an object of the present disclosure, a garment display device is provided. The garment display device may comprise an attachment base. The attachment base may comprise a pair of support arms comprising a left support arm and a right support arm and an anchor panel positioned between, and attached to, the left support arm and the right support arm. The anchor panel may comprise one or more openings configured to enable the anchor panel to be secured to a surface. The garment device may comprise a right primary arm plate rotatably attached to the right support arm via a first securing means and a left primary arm plate rotatably attached to the left support arm via a second securing means. The right and left primary arm plates may be rotatable within a single plane and may each comprise a plate support member comprising an upper surface, a lower surface, one or more side surfaces, and a recess within one of the lower or upper surfaces. The right and left primary arm plates may comprise an extender member extendably connected to one of the upper or the lower surfaces of the plate support member. The extender member may be configured to be slidable within the recess.

According to various embodiments, the left support arm, the right support arm, and the anchor panel may form a single, uninterrupted unit.

According to various embodiments, the garment display device may comprise the first securing means.

According to various embodiments, the first securing means may be configured to maintain a position of the right primary arm plate in relation to the right support arm.

According to various embodiments, the first securing means may comprise a screw.

According to various embodiments, the garment display device may comprise the second securing means.

According to various embodiments, the second securing means may be configured to maintain a position of the left primary arm plate in relation to the left support arm.

According to various embodiments, the second securing means may comprise a screw.

According to various embodiments, for each of the right and left primary arm plates, some or all of the extender member may be positioned within the recess.

According to various embodiments, for each of the right and left primary arm plates, the plate support member may comprise an extender securing device configured to maintain a position of the extender member within the recess.

According to various embodiments, the extender member may be configured to be extendable by sliding the extender member within the recess.

According to various embodiments, the garment display device may comprise a lengthening panel secured to the anchor panel.

According to various embodiments, each extender member may comprise a top surface, a bottom surface, and at least two cutouts extending from the top to the bottom surface of the extender member.

According to various embodiments, the plate support member may comprise at least one protrusion extending from the upper or lower surface of the plate support member.

According to various embodiments, the garment display device may comprise at least one secondary right arm plate and at least one secondary left arm plate. At least one of the secondary right arm plates may be rotatably and detachably attached to the primary right arm plate. At least one of the secondary left arm plates may be rotatably and detachably attached to the primary left arm plate. The secondary right and left arm plates may each comprise a secondary right and left arm plate support member, respectively, comprising an upper surface, a lower surface, and one or more side surfaces, and a secondary plate extender member extendably connected to one of the lower or upper surfaces of the secondary plate support member.

According to various embodiments, the garment display device may comprise at least one additional secondary right arm plate and at least one additional secondary left arm plate. Each additional secondary right arm plate may be rotatably and detachably attached to at least one other secondary right arm plate. Each additional secondary left arm plate may be rotatably and detachably attached to at least one other secondary left arm plate.

DETAILED DESCRIPTION

Figure 1:
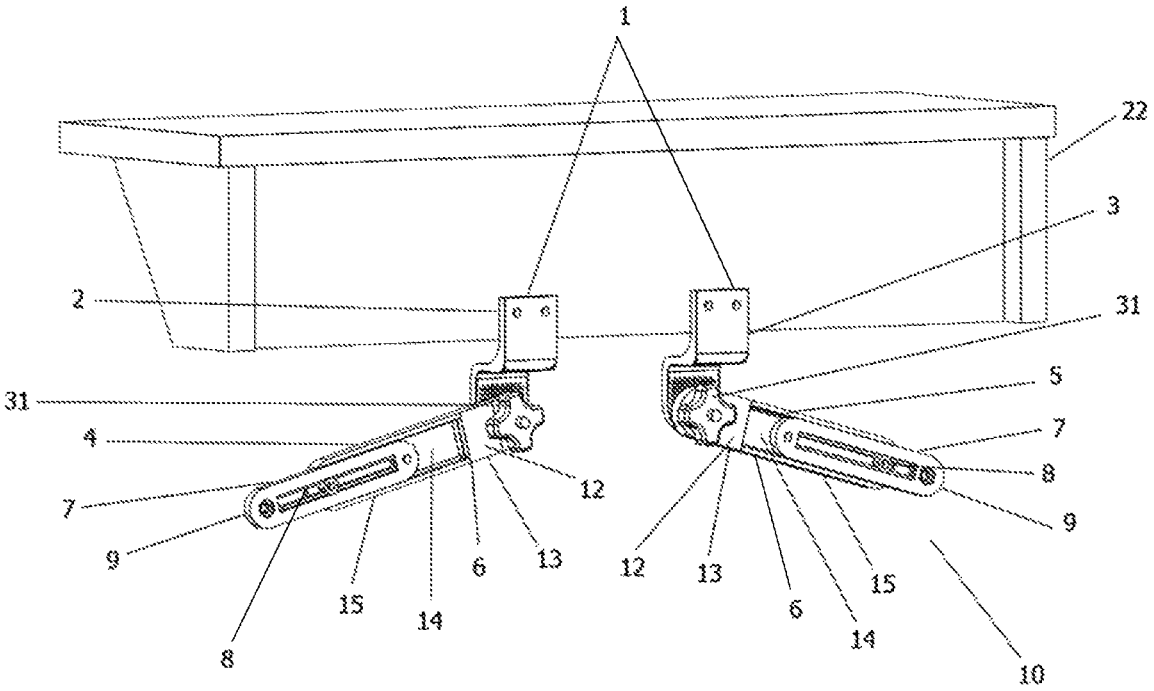
FIG. 1 is an angled rear view of a garment display device with support arms of the garment display device attached to a rear of a shelving unit, according to various embodiments of the present disclosure.
Figure 2:
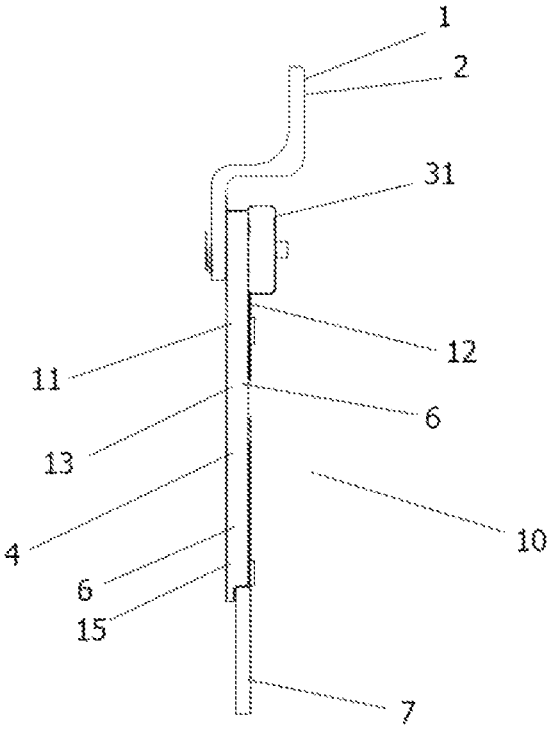
FIG. 2 is a side view of a garment display device, according to various embodiments of the present disclosure.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. These terms are merely intended to distinguish one component from another component, and the terms do not limit the nature, sequence or order of the constituent components. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

In this document, when terms such as "first" and "second" are used to modify a noun, such use is simply intended to distinguish one item from another, and is not intended to require a sequential order unless specifically stated. In addition, terms of relative position such as "vertical" and "horizontal", or "front" and "rear", when used, are intended to be relative to each other and need not be absolute, and only refer to one possible position of the device associated with those terms depending on the device's orientation.

Hereinafter, some embodiments of the present disclosure will be described in detail with reference to the drawings. In the drawings, the same reference numerals will be used throughout to designate the same or equivalent elements. In addition, a detailed description of well-known features or functions will be ruled out in order not to unnecessarily obscure the gist of the present disclosure.

Hereinafter, garment display devices and methods of use will be described with reference to the accompanying drawings. According to various embodiments, the garment display device may provide for the display of different styles of upper body garments, such as, but not limited to, sport jerseys, or other types of shirt, in an aesthetically pleasing way.

Referring now to FIG. 1, a garment display device 10 is illustratively depicted, according to various embodiments of the present disclosure, with support arms 2, 3 of the garment display device 10 attached to a rear of a shelving unit 22.

According to various embodiments, the garment display device 10 may comprise an attachment base 1. The attachment base 1 may comprise a left support arm 2 and a right support arm 3. The shape of the support arms 2 and 3 may vary, depending on a desired design of the garment display device 10. According to various embodiments, each support arm 2, 3 may be attached to a respective primary arm plate 4, 5 such that the left support arm 2 may be connected to the left primary arm plate 4, and the right support arm 3 may be connected to the right primary arm plate 5. According to various embodiments, each primary arm plate 4, 5 may be rotatably connected to its respective support arm 2, 3 in such a way that the attachment enables the primary arm plate (4 or 5) to rotate.

The primary arm plates 4, 5 each may be configured to rotate within a single plane. According to various embodiments, for one or more of the primary arm plates 4, 5, a rotation range within that plane may be at least 180 degrees. According to various embodiments, for one or more of the primary arm plates 4, 5, the rotation range within that plane may be at least 90 degrees.

The primary arm plates 4, 5 may be configured to be attached to the support arms 2, 3 by suitable securing means.

For example, in some embodiments, the primary arm plates 4, 5 may be configured to be attached to the support arms 2, 3 by a screw (not shown) and lock nut 31 that screws onto the screw (not shown), and that can be adjusted, as necessary, by the user. It is noted, however, that other suitable means for attaching the primary arm plates 4, 5 to the support arms 2, 3 may be incorporated while maintaining the spirit and functionality of the present disclosure. According to various embodiments, the securing means may be configured to enable a position of the primary arm plates 4, 5 in relation to the support arms 2, 3 to be maintained (e.g., via tension, pressure, mechanical connection, and/or other suitable means). According to various embodiments, the securing means may comprise a first securing means and a second securing means. The first securing means and the second securing means may be of a same or different securing means.

According to various embodiments, each primary arm plate 4, 5 may comprise a plate support member 6 and, in some embodiments, also an extender member 7 that is configured to be extendably connected to the plate support member 6. According to various embodiments, in examples where a sleeveless or short sleeved garment is to be hung from the garment display device 10, the garment display device 10 may be configured to be used without the extender member 7 and/or may not comprise the extender member 7. According to various embodiments, each primary arm plate 4 and 5 may be configured such that the respective primary arm plate 4, 5 may be extended in the plane of the length of the respective primary arm plate 4, 5.

According to various embodiments, an extension of each primary arm plate 4, 5 may be achieved by adjusting the extender member 7 so that the extender member 7 extends to a desired distance past a distal end 8 of the plate support member 6. Each primary arm plate 4, 5 may be configured to be retracted to a desired length by adjusting the extender member 7 back towards an opposing distal end 8 of the plate support member 6. According to various embodiments, when no extension is desired, the extender member 7 may be configured to be adjusted so that a distal end 9 of the extender member 7 does not extend past a distal end 8 of the plate support member 6. According to various embodiments, the left and right primary arm plates 4, 5 may be configured to be capable of being connected to one or more additional arm plates.

According to various embodiments, the plate support member 6 and extender member 7 of each primary arm plate 4, 5 may configured to be arranged in any suitable manner that allows for extension of the primary arm plates 4, 5. According to various embodiments, the extender member 7 may be configured to be extended by sliding the extender member 7 within the plate support member 6. For example, according to various embodiments, as shown, e.g., in FIG. 1, FIG. 2, FIG. 3A, FIG. 3B, and FIG. 3C, the plate support member 6 may comprise an upper surface 11, a lower surface 12, and one or more side surfaces 13. According to various embodiments, either the upper surface 11 or the lower surface 12 of the plate support member 6 may comprise a recess 14 extending at least partially along a length of the plate support member 6, with at least one end of the recess open at a distal end 8 of the plate support member 6. According to various embodiments, the recess 14 may extend substantially along a length of the plate support member 6. According to various embodiments, the recess 14 may extends along at least two-thirds of a length of the plate support member 6.

According to various embodiments, the garment display device 10 may comprise a retaining wall 15 bordering a length of the recess 14, whose outer surface is the side surface 13 of the plate support member 6. The extender member 7 may be configured to fit within the recess 14, with the extender member's 7 length bordered by the retaining wall 15, where it can be slid back and forth, along a plane of the respective primary arm plate 4, 5.

Figure 3A:
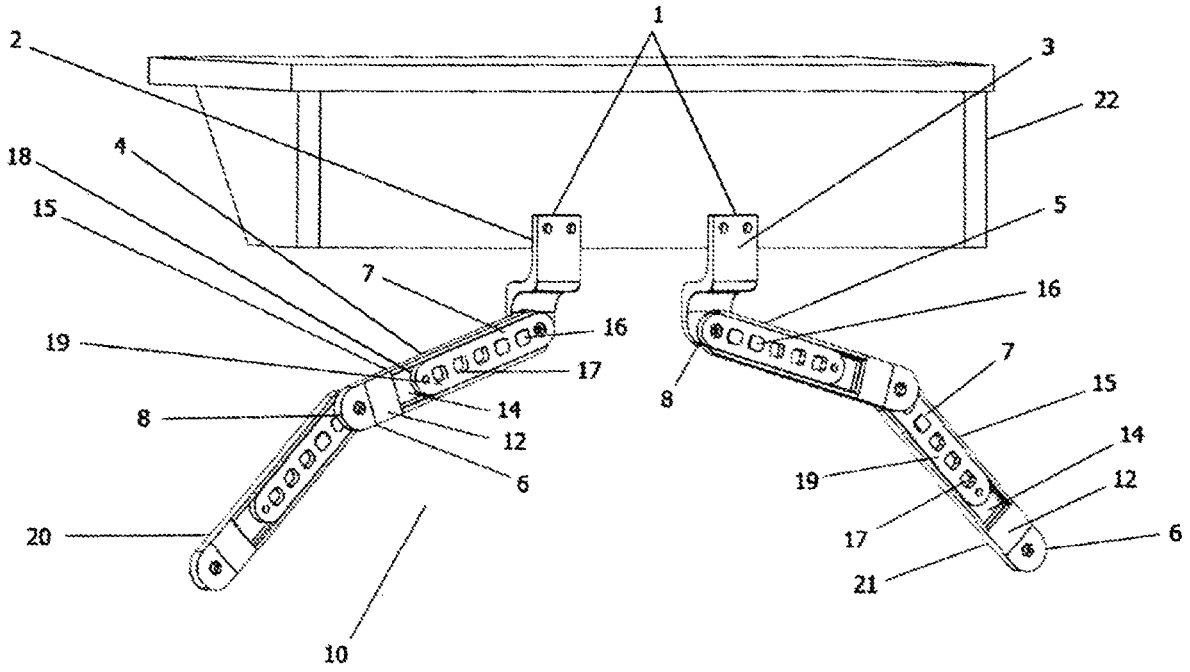
FIG. 3A is an angled rear view of a garment display device, having primary and secondary arm plates, where cutouts in the extender members may be repositioned on protrusions extending from a recess in plate support members, according to various embodiments of the present disclosure.

According to various embodiments, one or more of the primary arm plates 4, 5 may be configured to be extended by attaching the extender member 7 at a desired position along the recess 14 in the plate support member 6. For example, as shown in FIG. 3A, according to various embodiments, the garment display device 10 may comprise at least one protrusion 16 extending from the recess 14 in the plate support member 6. According to various embodiments, the garment display device 10 may comprise one or more (e.g., a plurality) of cutouts 17 in the extender member 7 extending throughout a depth of the extender member 7, from a top surface 18 to a bottom surface 19 of the extender member 7. Each cutout 17 may have a shape and/or size that enables the cutout 17 to be securely inserted onto a protrusion 16. The respective primary arm plate 4, 5 may be configured to be lengthened and/or shortened by attaching at least one of the protrusions 16 in at least one of the cutouts 17, thereby enabling the user to select a desired length.

As noted above, the left and right primary arm plates 4, 5 may be configured to be capable of being connected to one or more additional arm plates. This extendable design of the garment display device 10 enables a user to adjust a length of one or more of the primary arm plates 4, 5 enabling the user to hang an upper body garment, such as, e.g., a sport jersey or any other type of shirt. As showing in FIG. 3A, FIG. 3B and FIG. 3C, according to various embodiments, the garment display device 10 may comprise at least one left secondary arm plate 20 and/or at least one right secondary arm plate 21. Preferably, the at least one right secondary arm plates 20 and/or at least one left secondary arm plates 21 have the same, or similar, design as the left and right primary arm plates 4, 5, as described above. According to various embodiments, a first pair of left and right secondary arm plates 20, 21 may each be configured to be rotatably attached to their respective left and right primary arm plate 4, 5. According to various embodiments, the at least one secondary arm plates 20, 21 may be configured to rotate within a single plane.

According to various embodiments, the rotation range the at least one secondary arm plates 20, 21 within the single plane may be at least 180 degrees. According to various embodiments, the rotation range the at least one secondary arm plates 20, 21 within the single plane may be at least 90 degrees. According to various embodiments, the plane of rotation of the primary arm plates 4, 5 may the same or parallel to the plane of rotation of the one or more secondary arm plates 20, 21.

According to various embodiments, the primary arm plates 4, 5 may be configured to be attached to their respective secondary arm plates 20, 21 in a suitable manner configured to enable each arm plate 4, 5, 20, or 21 to rotate in the plane, while also being detachable from the neighboring arm plate 4, 5, 20, or 21. For example, in some embodiments, the primary arm plates 4, 5 may be configured to be attached to their respective secondary arm plates 20, 21 by a screw (not shown) and lock nut that screws onto the screw (not shown), and that can be adjusted, as necessary, by the user. It is noted, however, that other suitable securing means for attaching the primary arm plates 4, 5 to their respective secondary arm plates 20, 21 may be incorporated while maintaining the spirit and functionality of the present disclosure. According to various embodiments, the securing means may be configured to enable a position of the secondary arm plates 20, 21 in relation to the primary arm plates 4, 5 to be maintained (e.g., via tension, pressure, mechanical connection, and/or other suitable means). According to various embodiments, the securing means may comprise a first securing means and a second securing means. The first securing means and the second securing means may be of a same or different securing means.

According to various embodiments, one or more additional pairs of secondary left and/or right arm plates 20, 21 may be attached to the first pair of secondary arm plates 20, 21. According to various embodiments, the one or more additional pairs of secondary left and/or right arm plates 20, 21 may be configured to be attached in a same or similar manner as the first pair of secondary arm plates 20, 21 was attached to the primary arm plates 4, 5. According to various embodiments, a plurality of left and/or right secondary arm plates 20, 21 may be configured to be connected to the garment display device 10.

According to various embodiments, the primary arm plates 4, 5 may be configured to be attached to the secondary arm plates 20, 21 such that the plate support member 6 of one arm plate 4, 5, 20, or 21 may be attached to the extender member 7 of another arm plate 4, 5, 20, or 21. Thus, according to some embodiments, as shown, e.g., in FIG. 3A, FIG. 3B, and FIG. 3C, the plate support member 6 on the primary arm plate 4, 5 may be configured to be attached to the plate extender member 7 of a neighboring secondary arm plate 20, 21. According to some embodiments, the primary plate (e.g., plate 4 or 5) extender member 7 may be configured to be attached to the plate support member 6 of a neighboring secondary arm plate 20, 21.

According to various embodiments in which the garment display device 10 comprises more than one pair of secondary arm plates 20, 21, each pair of secondary arm plates 20, 21 may be configured to be attached to a neighboring pair of secondary arm plates 20, 21 such that the plate support member 6 of one secondary arm plate 20 or 21 is attached to the extender member 7 of another secondary arm plate 20 or 21.

According to various embodiments, the garment display device 10 may be configured to be attached/coupled to a surface such as, e.g., a wall, where it may be available for the hanging of a garment. The garment display device 10 may be configured to be attached to the surface in a suitable manner such as, but not limited to, by nailing or screwing. According to various embodiments as shown, e.g., in FIG. 1, FIG. 3A, FIG. 3B and FIG. 3C, the support arms 2, 3 of the garment display device 10 may be configured to be attached to a shelving unit 22. According to various embodiments, the support arms 2, 3 may be configured to be attached at a suitable position on the shelving unit 22.

As noted above, a shape of one or more of the support arms 2, 3 may vary, depending on a desired design of the garment display device 10. As shown, e.g., in FIG. 1, FIG. 2, FIG. 3A, and FIG. 3B, according to some embodiments, the support arms 2, 3 may be substantially Z-shaped. This Z-shaped design enables the support arms 2, 3 to be attached to a surface such as, e.g., the back of a shelving unit 22, while providing enough forward space for a garment (not shown) to hang from the garment display device 10, to hang neatly, without being impeded by surfaces behind the garment (not shown).

Figure 4:
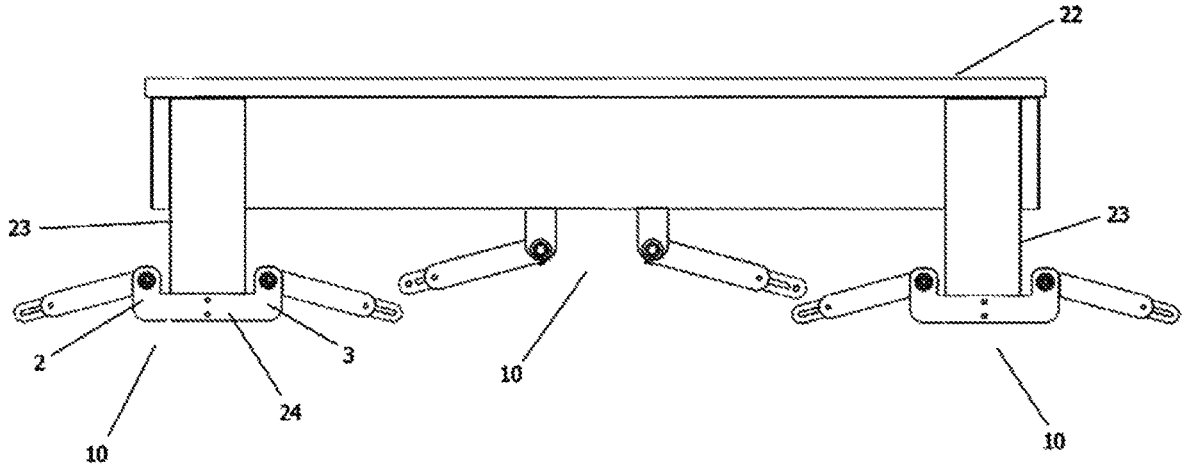
FIG. 4 is a front view of multiple garment display devices attached to a shelving unit, according to various embodiments of the present disclosure.
Figure 5:
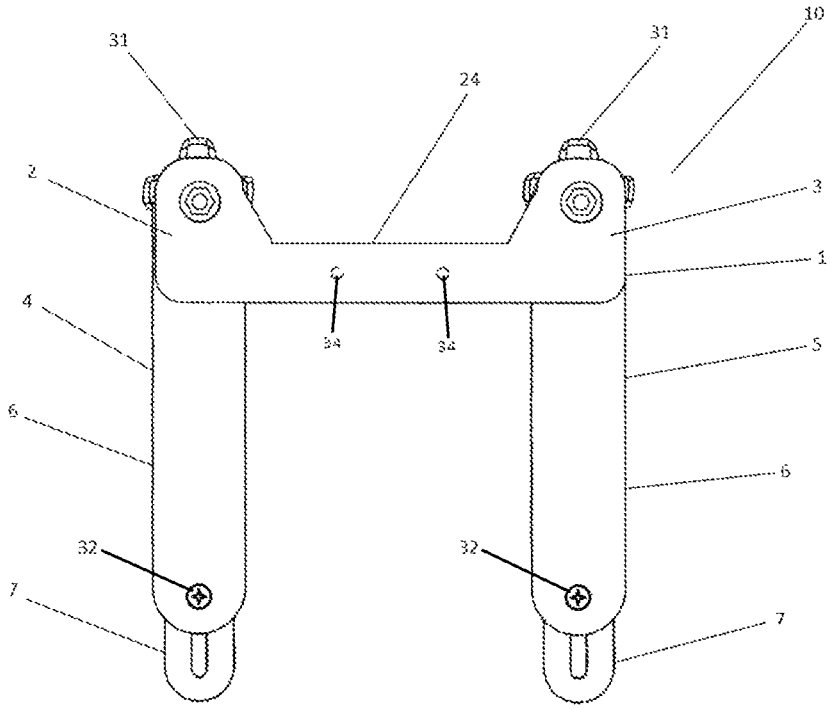
FIG. 5. is a front view of a garment display device with an anchor plate attached to support arms, according to various embodiments of the present disclosure.

According to various embodiments, multiple garment display devices 10 may be used on a same hanging unit. For example, according to various embodiments, as shown in FIG. 4, more than one garment display device 10 may be attached to a shelving unit 22. The garment display devices 10 may be hung far enough from each other such that a garment (not shown) may hang from each of the more than one garment display devices 10 while being clearly displayed.

According to various embodiments, the garment display devices 10 may be configured to be hung at a same vertical level or at differing vertical levels. According to various embodiments, a lengthening panel 23 may be used to achieve these height variations of the garment display devices 10. For example, as shown in FIG. 4, according to various embodiments, the garment display device 10 may comprise one or more lengthening panels 23 configured to be attached to a shelving unit 22. The lengthening panel 23 may be configured to be attached on one end to the shelving unit 22, and the garment hanging device 10 may be configured to be attached at a desired height along the lengthening panel 23.

Figure 3B:
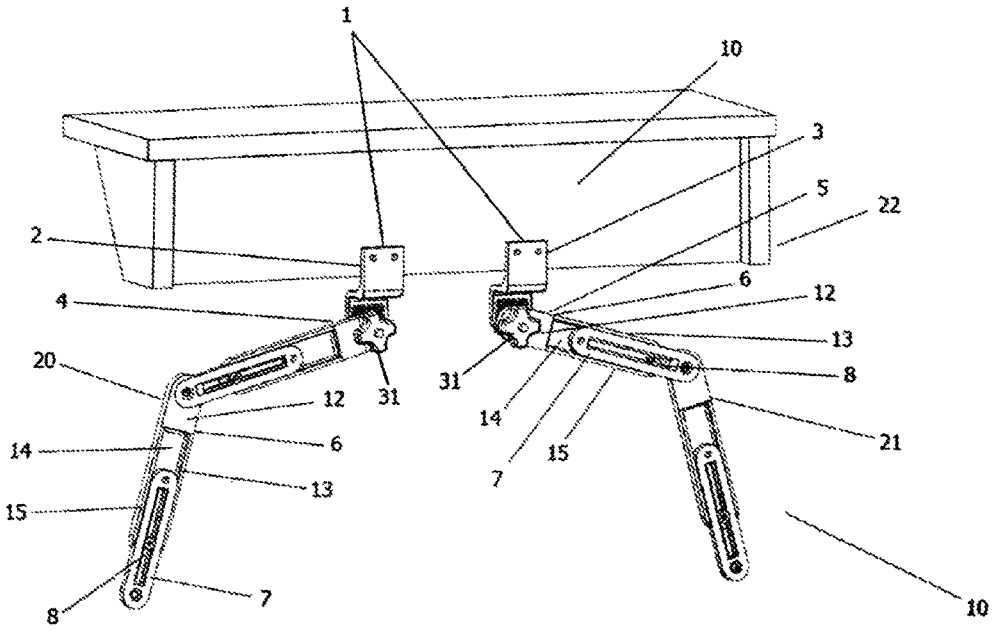
FIG. 3B is an angled rear view of a garment display device, having primary and secondary arm plates, having extender members that slide within a recess in plate support members, according to various embodiments of the present disclosure.
Figure 3C:
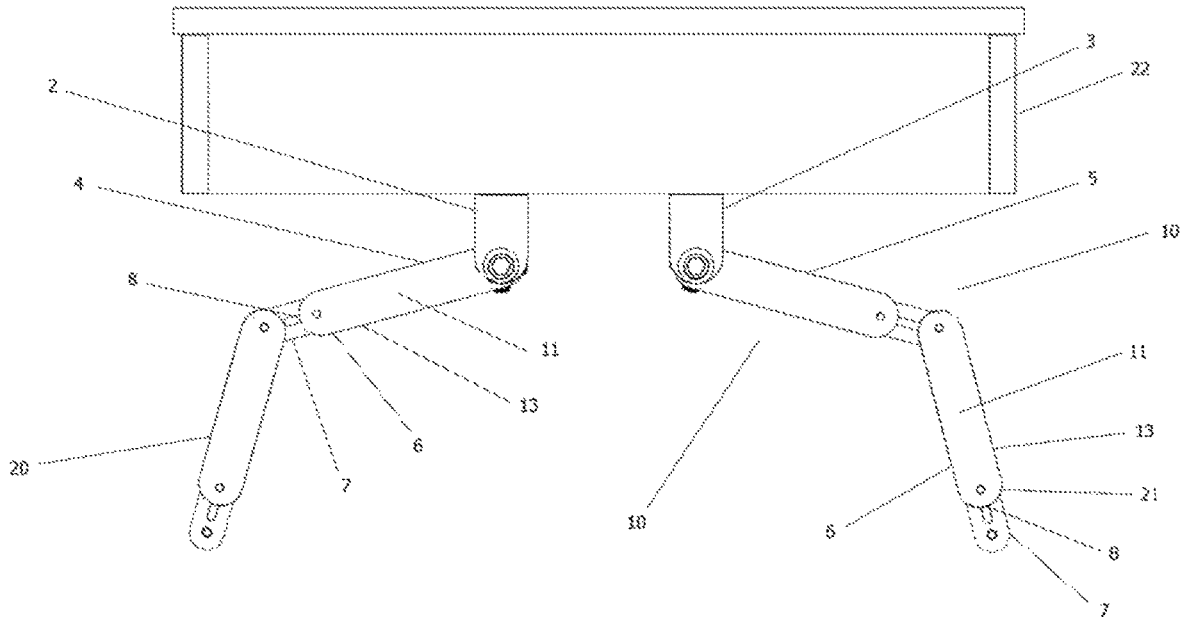
FIG. 3C is a front view of a garment display device, having primary and secondary arm plates, having extender members that slide within a recess in plate support members, according to various embodiments of the present disclosure.

According to various embodiments, as shown, e.g., in FIG. 1, FIG. 3A, and FIG. 3B, the attachment base 1 may comprise an independent left support arm 2 and an independent right support arm 3. As shown, e.g., in FIGS. 4-8, according to some embodiments, the left and right support arms 2, 3 may be connected to one another by an anchor panel 24. According to various embodiments, the anchor panel 24 may be an independent unit attached to the left support arm 2 and/or the right support arm 3, or the support arms 2, 3 and the anchor panel 24 may form a single, uninterrupted unit. The anchor panel 24 may have any suitable shape. As shown in FIG. 7, according to some embodiments, the anchor panel 24 may comprise a flat panel, forming a substantially U-shaped attachment base 1, along with the support arms 2 and 3. According to various embodiments, the flat panel may be configured to enable the anchor panel 24 to lay flat against a flat surface on which to be secured. According to various embodiments, the flat surface on which to be secured may comprise the lengthening panel 23.

Figure 6:
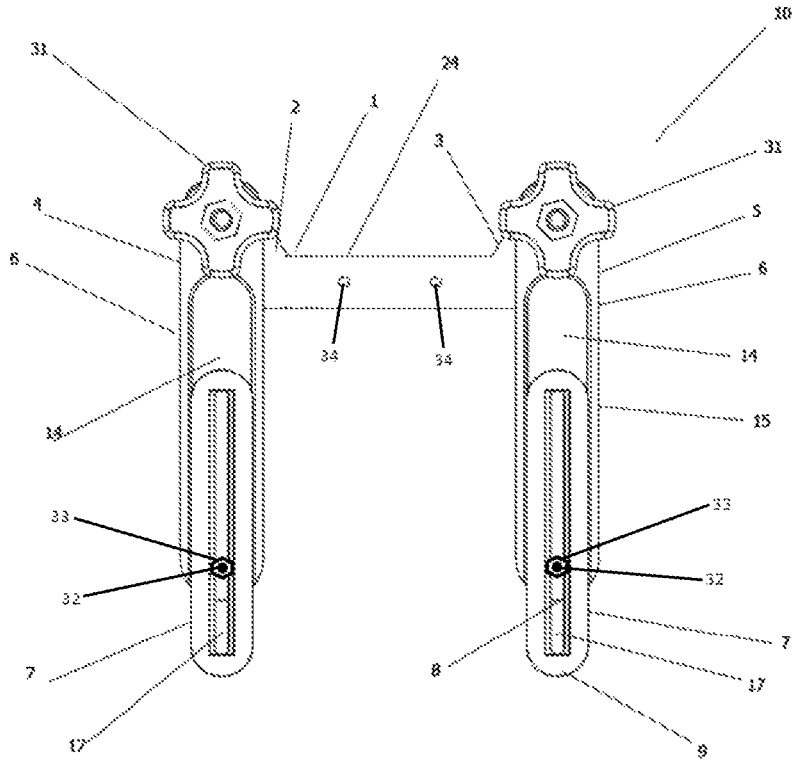
FIG. 6 is a rear view of a garment display device with an anchor plate attached to support arms, according to various embodiments of the present disclosure.
Figure 7:
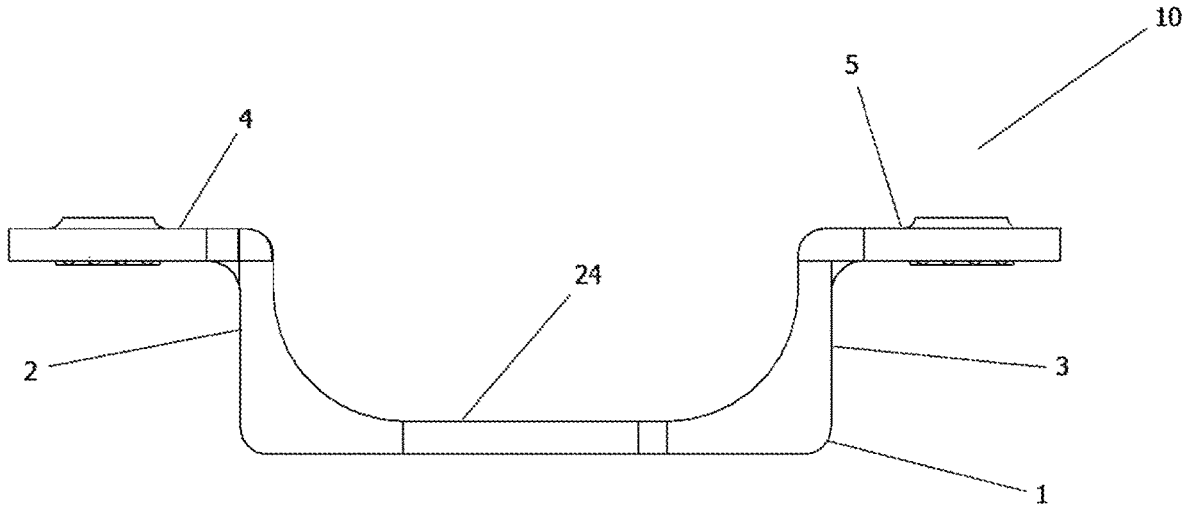
FIG. 7 is a top view of a garment display device with an anchor plate attached to support arms, according to various embodiments of the present disclosure.

As shown in FIG. 6, according to some embodiments, the extender member 7 may comprise a cutout 17 extending along at least a portion of the length of the extender member 7. According to some embodiments, the cutout 17 may extend down at least 80 percent of a length of the extender member 7. According to some embodiments, an extender securing device such as, e.g., a screw 32, may be configured to extend through the plate support member 6, and cutout 17 in the extender member 7, thereby connecting the plate support member 6 and the extender member 7. A device such as a nut 33 may be used to hold the securing device in place. It is noted, however, that other suitable securing devices may be incorporated while maintaining the spirit and functionality of the present disclosure. The extender securing device may be configured to maintain a position of the extender member 17 within the recess 14. According to various embodiments, some or all of the extender member 17 may be positioned within the recess 14. According to various embodiments, the extender member 17 may be configured to be extendable by sliding the extender member 17 within the recess 14.

According to various embodiments, the anchor panel 24 may comprise one or more anchor holes 34 configured to enable a securing mechanism to pass through the anchor panel and secure the garment display device 10 to a surface (e.g., a wall and/or other suitable surface). According to various embodiments, the anchor panel 24 and support arms 2, 3 may be shaped and/or configured to position the primary arm plates 4, 5 away from the surface when the anchor panel 24 is secured to the surface.

According to various embodiments, components of the garment display device 10 may comprise metal, polymeric material, and/or one or more other suitable materials. There may be various ways of making and assembling the components of the present device. According to various embodiments, the components of the garment display device 10 may be made by any suitable method such as, for example, molding and/or 3-D printing. The components may be configured to be attached to one another by any suitable method such as, e.g., by nails, screws, nuts/bolts, and/or other suitable securing means.

Figure 8:
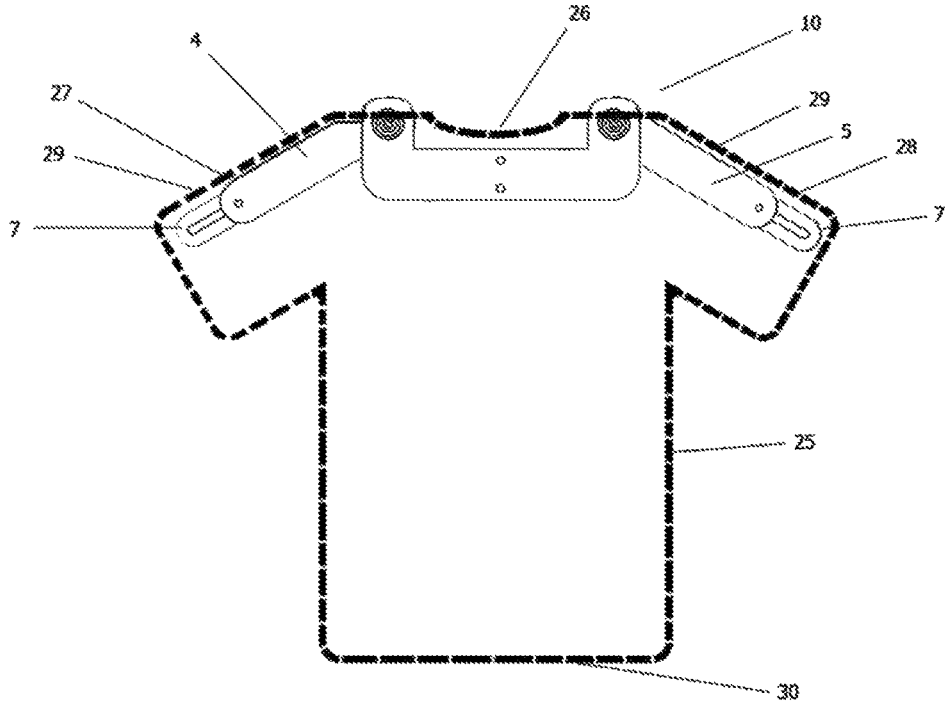
FIG. 8 is a front view of a garment display device with a garment hanging on the garment display device, according to various embodiments of the present disclosure.

According to various embodiments, the present disclosure comprises methods of using the garment display device 10 to hang upper body garments, and display them in an aesthetically pleasing way. According to various embodiments, to use the garment display device 10, the orientation of the left and right primary arm plates 4 and 5 may be configured by a user in a substantially vertical downward position, as shown, e.g., in FIG. 5 and FIG. 6. If the garment display device 10 also includes one or more pairs of secondary arm plates 20, 21, these secondary arm plates 20, 21 may also oriented in a substantially vertical downward position. This downward orientation enables the user to easily insert a neck 26 of the upper body garment 25 (shown in FIG. 8) around the primary arm plates 4, 5 and, if present, secondary arm plates 20, 21, in an upward motion. As shown in FIG. 8, the user may raise the left primary arm plate 4 and left secondary arm plate 20 (if present) upwards toward a left shoulder portion 27 (shown in FIG. 8) of the garment 25, and raise the right primary arm plate 5 and right secondary arm plate 21 (if present) upwards toward the right shoulder portion 28 of the garment 25. According to various embodiments, the user may shorten or lengthen a length of the primary arm plates 4, 5 and if present, a length of the secondary arm plates 20, 21, by adjusting the extender panels 7, to provide support for the arms 29 of the garment 25, which may vary, depending on the type of garment 25.

The abovementioned raising of the garment 25, and of the primary arm plates 4 and 5, and secondary arm plates 20 and 21 (if present), may be most easily achieved by the user inserting their arms into the garment 25 from a bottom 30 of the garment 25. As shown, e.g., in FIG. 8, these steps result in a garment 25 hanging on the garment display device 10 in a manner that provides support for the garment arms 29, enabling a well-supported and aesthetically pleasing display of the garment 25.

In those embodiments where the garment display device 10 is configured to be attached to a shelving unit, the user may display items on the shelving unit such as, for example collectables, photos, trophies, hats, and books. This is especially desirable for users, as they can display their garment, such as, e.g., a team jersey, alongside other items, such as, e.g., team paraphernalia.

Many modifications and other examples of the disclosure set forth herein will come to mind to those skilled in the art to which this disclosure pertains, having the benefit of the teachings presented in the foregoing descriptions and the associated drawings. Therefore, it is to be understood that the disclosure is not to be limited to the specific examples disclosed and that modifications and other embodiments are intended to be included within the scope of the appended claims. The features and functions described above, as well as alternatives, may be combined into many other different systems or applications. Various alternatives, modifications, variations or improvements may be made by those skilled in the art, each of which is also intended to be encompassed by the disclosed embodiments.

Moreover, although the foregoing descriptions and the associated embodiments describe aspects of the disclosure in the context of certain example combinations of structural elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A garment display device comprising:
an attachment base comprising:
a pair of support arms comprising a left support arm and a right support arm; and
an anchor panel positioned between, and attached to, the left support arm and the right support arm,
wherein the anchor panel comprises one or more openings configured to enable the anchor panel to be secured to a surface;
a right primary arm plate rotatably attached to the right support arm via a first securing means; and
a left primary arm plate rotatably attached to the left support arm via a second securing means,
wherein:
the right and left primary arm plates:
are rotatable within a single plane; and
each comprise:
a plate support member, coupled to a support arm, of the pair of support arms, the plate support member comprising:
an upper surface;
a lower surface;
one or more side surfaces; and
a recess within one of the upper or lower surfaces; and
an extender member extendably connected to one of the upper or the
lower surfaces of the plate support member, and
the extender member is configured to be slidable within the recess.

2. The garment display device of claim 1, wherein the left support arm, the right support arm, and the anchor panel form a single, uninterrupted unit.

3. The garment display device of claim 1, further comprising the first securing means.

4. The garment display device of claim 3, wherein the first securing means is configured to maintain a position of the right primary arm plate in relation to the right support arm.

5. The garment display device of claim 3, wherein the first securing means comprises a screw.

6. The garment display device of claim 1, further comprising the second securing means.

7. The garment display device of claim 6, wherein the second securing means is configured to maintain a position of the left primary arm plate in relation to the left support arm.

8. The garment display device of claim 6, wherein the second securing means comprises a screw.

9. The garment display device of claim 1, wherein, for each of the right and left primary arm plates, some or all of the extender member is positioned within the recess.

10. The garment display device of claim 9, wherein, for each of the right and left primary arm plates, the plate support member further comprises an extender securing device configured to maintain a position of the extender member within the recess.

11. The garment display device of 1, wherein the extender member is configured to be extendable by sliding the extender member within the recess.

12. The garment display device of claim 1, further comprising a lengthening panel secured to the anchor panel.

13. The garment display device of claim 1, wherein:

each extender member comprises:

a top surface;

a bottom surface; and at least two cutouts extending from the top to the bottom surface of the extender member; and the plate support member further comprises at least one protrusion extending from the upper or lower surface of the plate support member.

14. The garment display device of claim 1, further comprising:

at least one secondary right arm plate; and at least one secondary left arm plate, wherein:

at least one of the secondary right arm plates is rotatably and detachably attached to the primary right arm plate, at least one of the secondary left arm plates is rotatably and detachably attached to the primary left arm plate, and the secondary right and left arm plates each comprise a secondary plate support member, respectively, comprising an upper surface, a lower surface, and one or more side surfaces, and a secondary plate extender member extendably connected to one of the upper or lower surfaces of the secondary plate support member.

15. The garment display device of claim 14, further comprising:

at least one additional secondary right arm plate; and at least one additional secondary left arm plate, wherein:

each additional secondary right arm plate is rotatably and detachably attached to at least one other secondary right arm plate, and each additional secondary left arm plate is rotatably and detachably attached to at least one other secondary left arm plate.

* * * * *